US007766713B2

(12) United States Patent
Bae et al.

(10) Patent No.: US 7,766,713 B2
(45) Date of Patent: Aug. 3, 2010

(54) METHOD OF MANUFACTURING BARRIER RIB FOR PLASMA DISPLAY PANEL

(75) Inventors: Byeong-Soo Bae, Daejeon (KR); Jung-Hwan Kim, Daejeon (KR); Ji-Hoon Ko, Daejeon (KR); Kyung-Ho Jung, Daejeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 502 days.

(21) Appl. No.: 11/918,221

(22) PCT Filed: Feb. 3, 2006

(86) PCT No.: PCT/KR2006/000404

§ 371 (c)(1),
(2), (4) Date: Oct. 11, 2007

(87) PCT Pub. No.: WO2006/112591

PCT Pub. Date: Oct. 26, 2006

(65) Prior Publication Data

US 2009/0085482 A1 Apr. 2, 2009

(30) Foreign Application Priority Data

Apr. 19, 2005 (KR) ..... 10-2005-0032475

(51) Int. Cl.
*H01J 17/49* (2006.01)

(52) U.S. Cl. ..... 445/24; 445/25; 313/587

(58) Field of Classification Search ..... 445/24–25; 313/582–587
See application file for complete search history.

(56) References Cited

U.S. PATENT DOCUMENTS 5,541,479 A * 7/1996 Nagakubo ..... 313/586
5,853,446 A * 12/1998 Carre et al. ..... 65/17.3

FOREIGN PATENT DOCUMENTS

| | | |
|---|---|---|
| JP | 09-102273 | 4/1997 |
| JP | 10-291834 | 11/1998 |
| JP | 10-326571 | 12/1998 |
| JP | 11-016488 | 1/1999 |
| JP | 11-016490 | 1/1999 |
| JP | 11-071130 | 3/1999 |

(Continued)

*Primary Examiner*—Nimeshkumar D Patel
*Assistant Examiner*—Anne M Hines
(74) *Attorney, Agent, or Firm*—The Nath Law Group; Jerald L. Meyer; Jiaxiao Zhang

(57) ABSTRACT

Disclosed herein is a method of manufacturing a barrier rib for a plasma display panel, including a silicon compound resin. The method according to a first embodiment of this invention includes providing a silicon compound resin layer on a substrate; pressing the silicon compound resin layer using a master having a pattern corresponding to the shape of a barrier rib to be transferred; and curing the silicon compound resin and then releasing the master. In addition, the method according to a second embodiment includes loading a silicon compound resin into grooves of a master having a pattern corresponding to the shape of a barrier rib; pressing the master on a substrate to transfer the silicon compound to the substrate; and curing the transferred silicon compound resin and then releasing the master.

18 Claims, 1 Drawing Sheet

FOREIGN PATENT DOCUMENTS

| | | | |
|---|---|---|---|
| JP | 11-185605 | | 7/1999 |
| KR | 10-1999-0085890 | | 12/1999 |
| KR | 1020000001058 | A | 1/2000 |
| KR | 1020000002099 | A | 1/2000 |
| KR | 1020000014546 | A | 3/2000 |
| KR | 100304888 | B1 | 7/2001 |

* cited by examiner

[Fig. 1]
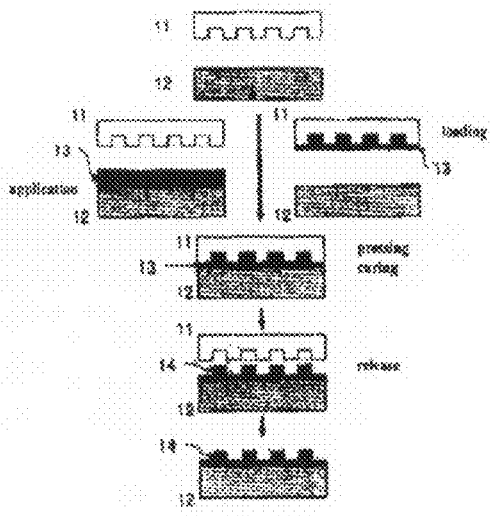
[Fig. 2]
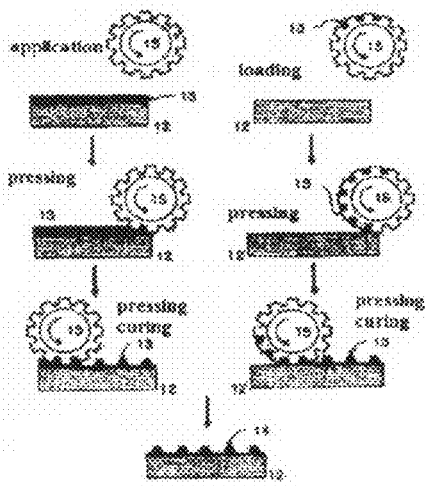
[Fig. 3]
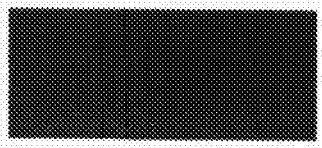
[Fig. 4]
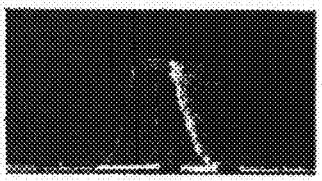

METHOD OF MANUFACTURING BARRIER RIB FOR PLASMA DISPLAY PANEL

TECHNICAL FIELD

The present invention relates, in general, to a method of manufacturing a barrier rib for a plasma display panel (PDP), and, more particularly, to a method of manufacturing a barrier rib for a PDP, which is advantageous because a barrier rib having a fine and complicated shape can be simply and precisely manufactured using a material, which can be cured at a low temperature and has fluidity, through a continuous process.

BACKGROUND ART

Generally, a barrier rib for a PDP is a structure formed in a dielectric layer, which is commonly provided on an electrode layer, formed on a rear glass substrate having address electrodes patterned to be parallel to each other. The barrier rib functions to maintain a discharge distance in the panel and to prevent electrical and optical interference between adjacent cells, and has a width of 40~100 □ and a height of 50~200 □.

In order to manufacture the barrier rib of a PDP, a frit material composed mainly of low melting point glass is used in a slurry or paste phase. Techniques for the formation of a barrier rib using such a material include, for example, a screen-printing process, a sandblasting process, a photolithographic process, and a molding process.

The paste or slurry of the frit material is prepared in the shape of a barrier rib and is then sintered at a high temperature of 500~600° C. to cure the glass frit. When Pb, serving as a representative softening material, is not added, a sintering process should be conducted at a higher temperature. However, among barrier rib materials, Pb at 500° C. or higher acts as an environmental pollutant. In the case where large amounts of waste are generated, as when manufacturing the barrier rib of a rear substrate, costs of treatment of environmental pollutants and waste are increased. Further, repeated high-temperature process for use in manufacturing a barrier rib suffers because the dimensions of the glass substrate vary, a non-uniform pattern is formed, the defect rate of a PDP is increased, and the screen size of the panel is difficult to enlarge. Thus, the PDP substrate supporting the barrier rib should also be formed of specific glass which does not soften at high temperatures.

A conventional 42-inch panel has been manufactured by preparing a dielectric layer as high as the barrier rib using a screen-printing process and then forming a barrier rib structure using a sandblasting process. However, when manufacturing PDPs, such as HDTVs, having 60-inch panels or larger, not only smaller pitches between the structures but also flatness are required. Hence, a screen-printing process through multi-layer printing and a sandblasting process are unsuitable for the fabrication of complicated structures having accurate dimensions. With the aim of overcoming the complication of the process due to multi-layer screen printing and realizing the formation of uniform barrier ribs over the entire panel, Japanese Patent Laid-open Publication Nos. 9-102273 and 10-291834 disclose a method of manufacturing a barrier rib layer through a single process using a transfer film (a composite film comprising a film forming material layer formed using a glass paste composition and a support film, and a cover film laminated on the film forming material layer to be easily removed). Although this method is advantageous because the process is simple, it has the drawbacks, such as limited use of the sintered low melting point glass as a substrate, difficulty in the formation of a fine pattern structure, poor surface flatness, generation of large amounts of environmental waste, etc. Therefore, there is a need for the development of a material that may be formed into a thick film through a single process and may easily form fine patterns, in order to manufacture a PDP having a large area and high image quality.

In manufacturing a PDP barrier rib, in addition to a conventionally used sandblasting process, a mold- or roll-pressing process may be used, which is advantageous in terms of realizing excellent quality of the resultant barrier rib, simplified manufacturing processes, and decreased manufacturing costs. This process is conducted by applying a paste containing a barrier rib material on a glass substrate or a metal substrate such as titanium and then drying it, or by laminating a dry film, followed by pressing the dried paste or the dry film using a flat type mold or a cylindrical roll type mold having a pattern shape, which is opposite to that of a barrier rib, thereby forming a desired barrier rib. Technical contents regarding the above process are disclosed in Japanese Patent Laid-open Publication Nos. 11-185605 and 10-3265712, Japanese Patent Application No. 9-170148, and Korean Patent Application Nos. 1998-54538, 1998-21101, 1998-22675, and 1998-18584. Typically, the paste contains inorganic material (glass frit, loading ceramics ($Al_2O_3$, $TiO_2$, $ZrO_2$, etc.)) as the barrier rib material, and further includes organic material (solvent, binder, thixotropic agent, plasticizer, diluent, other additives) to obtain fluidity required for printing and pressing. The paste thus obtained is dried and then pressed using a flat type mold having a pattern shape, which is opposite to that of the barrier rib to be manufactured, to form a barrier rib, which is then removed from the mold and sintered. Subsequently, a phosphor is printed on side surfaces and a lower surface of the barrier rib, thus completing a rear substrate of a PDP. In these methods, however, the release of the mold from the formed barrier rib is difficult to assure.

Likewise, methods of manufacturing a barrier rib are proposed using a roll having grooves as a pattern having a shape opposite to that of a barrier rib, instead of the flat type mold. This method is conducted in a manner such that the dried paste or dry film is pressed in the shape of a barrier rib using the roll, and then sintered, thereby manufacturing a desired barrier rib.

Other than such mechanical pressing processes, Japanese Patent Application Nos. 9-165907 and 9-243523 and Korean Patent Application No. 1998-34029 disclose methods of manufacturing a barrier rib, comprising processing a metal or polymer material using a flat mold or roll or molding it using a photo etching process to have a pattern having a shape opposite to that of a barrier rib, loading a paste or slurry containing a barrier rib material into the pattern, drying the loaded paste or slurry and then removing the mold, which was proposed as a technique for forming a fine barrier rib. Further, grooves as a pattern corresponding to the shape of a barrier rib are formed through a photolithographic process or a mold pressing process, and are then filled with a barrier rib material. In this case, the filling procedure is carried out using a printing process using a squeezer or a tape casting process. After the barrier rib material is loaded, it is dried and laminated on a substrate having address electrodes printed thereon. The mold is released, and the barrier rib is sintered and is then printed on side surfaces and a lower surface thereof with the use of a phosphor, to manufacture a desired rear substrate of a PDP.

In the molding process, the problems regarding fluidity of the barrier material applied on the mold and, as well, reactivity between the barrier rib material and the mold, or release there between upon removing the mold from the formed barrier rib negatively affect the manufacture of the barrier rib. Further, when the mold is filled with the barrier rib material, all pattern grooves of the mold should be uniformly filled with the material in order to form a uniform barrier rib. When the mold is removed, the sintered barrier rib material in the patterns of the mold should have no reactivity with the mold in order to be easily released from the mold, to obtain non-degraded uniform barrier ribs. However, it is difficult to achieve such objects using the conventional methods.

DISCLOSURE OF INVENTION

Technical Problem

Accordingly, the present invention has been made keeping in mind the above problems occurring in the related art, and an object of the present invention is to provide a method of manufacturing a barrier rib for a PDP, in which a barrier rib having a fine and complicated shape can be simply and precisely manufactured from a material that may be cured at a low temperature of 300° C. or less and that has fluidity through a continuous process.

Technical Solution

According to a first embodiment of the present invention for achieving the above object, a method of manufacturing a barrier rib for a plasma display panel is provided, comprising providing a silicon compound resin layer on a substrate; pressing the silicon compound resin layer using a master having a pattern corresponding to the shape of a barrier rib to transfer it; and curing the silicon compound resin and then releasing the master.

According to a second embodiment of the present invention, a method of manufacturing a barrier rib for a plasma display panel is provided, comprising loading a silicon compound resin into grooves of a master having a pattern corresponding to the shape of a barrier rib; pressing the master on a substrate to transfer the silicon compound resin to the substrate; and curing the transferred silicon compound resin and then releasing the master.

In the method according to the first and second embodiments of the present invention, the silicon compound resin preferably further comprises a pigment.

In the method according to the first and second embodiments of the present invention, the silicon compound resin preferably further comprises a UV curing agent or a heat curing agent.

In the method according to the first and second embodiments of the present invention, the silicon compound preferably comprises a compound including a compound material represented by Formula 1 below or by $R_6SiO_{1.5}$ as a repeating unit, or a polymer including the compound material as a monomer:

Formula 1

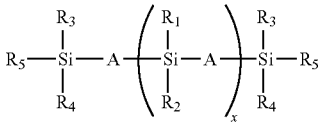

wherein X is an integer including 0, and $R_1$, $R_2$, $R_3$, $R_4$, $R_5$, and $R_6$ are each a linear, branched or cyclic $C_{1-12}$ hydrocarbon group having a functional group selected from among an alkyl group, a ketone group, an acryl group, a methacryl group, an allyl group, an alkoxy group, an aromatic group, a halogen group, an amino group, a mercapto group, an ether group, an ester group, an alkoxy group, a sulfone group, a nitro group, a hydroxy group, a cyclobutene group, a carbonyl group, a carboxyl group, an alkyd group, a urethane group, a vinyl group, a nitrile group, hydrogen, an epoxy group, and mixtures thereof, and A is O or NH, in which the $C_{1-12}$ hydrocarbon group includes fluorine substituted for hydrogen thereof.

In the method according to the first and second embodiments of the present invention, the pigment is preferably selected from the group consisting of ruthenium oxide, nickel oxide, titania, titania-alumina, iron oxide, titanium oxide, barium nitride, aluminum oxide, and mixtures thereof.

In the method according to the first and second embodiments of the present invention, the master is preferably a flat type or a roll type.

In addition, the present invention provides a plasma display panel, comprising a silicon compound resin and manufactured using the method according to the first embodiment or the second embodiment.

Advantageous Effects

According to the present invention, a barrier rib composition in a liquid phase, which does not contain PbO and may be cured even at a low temperature not higher than 300° C., can be easily formed into a barrier rib through a transferring process using a master. Further, since the temperature of the curing process may be decreased, a soda lime glass substrate or a plastic substrate, suitable for curing at low temperature, may be used.

In addition, a silicon compound resin is used as a material for a barrier rib, and it is thus possible to precisely manufacture a barrier rib having a fine and complicated shape and to continuously manufacture the barrier rib. Upon manufacturing the barrier rib, the barrier rib material is not excessively used, thus generating less environmental pollution. Moreover, the manufacturing processes are simplified, resulting in reduced manufacturing costs.

BRIEF DESCRIPTION OF THE DRAWINGS

FIG. 1 is views sequentially showing a process of manufacturing a barrier rib for a PDP according to a first embodiment (left side) and a second embodiment (right side) of the present invention, using a flat type master;

FIG. 2 is views sequentially showing a process of manufacturing a barrier rib for a PDP according to a first embodiment (left side) and a second embodiment (right side) of the present invention, using a roll type master; and FIGS. 3 and 4 are a photograph and an enlarged photograph, respectively, showing a barrier rib for a PDP, manufactured according to the present invention.

BEST MODE FOR CARRYING OUT THE INVENTION

Hereinafter, a detailed description will be given of the present invention.

Based on the present invention, a method of manufacturing a barrier rib composed mainly of a silicon compound resin through a transferring process using a master is provided. The transferring process using a flat type master or a roll type master is classified into a micro embossing process for applying a silicon compound resin layer on a rear substrate and then pressing the silicon compound resin layer, using the above master, to be transferred, and a stamping process for filling grooves of a master with a silicon compound resin, and pressing the master on a rear substrate to transfer the silicon compound.

The silicon compound used in the present invention is an organic-inorganic hybrid material, and preferably includes siloxane (—Si—O—) or silazane (—Si—NH—) as a main skeleton, in which any one of four bonding regions of a silicon atom is a linear, branched or cyclic $C_{1-12}$ hydrocarbon group. More preferably, the silicon compound comprises a compound including a compound material represented by Formula 1 below or by $R_6SiO_{1.5}$ as a repeating unit, or a polymer including the compound material as a monomer:

Formula 1

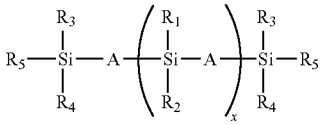

wherein X is an integer including 0, and $R_1$, $R_2$, $R_3$, $R_4$, $R_5$, and $R_6$ are each a linear, branched or cyclic $C_{1-12}$ hydrocarbon having a functional group selected from among an alkyl group, a ketone group, an acryl group, a methacryl group, an allyl group, an alkoxy group, an aromatic group, a halogen group, an amino group, a mercapto group, an ether group, an ester group, an alkoxy group, a sulfone group, a nitro group, a hydroxy group, a cyclobutene group, a carbonyl group, a carboxyl group, an alkyd group, a urethane group, a vinyl group, a nitrite group, hydrogen, an epoxy group, and mixtures thereof, and A is O or NH, in which the $C_{1-12}$ hydrocarbon group includes fluorine atoms substituted for some hydrogen atoms thereof.

In this regard, examples of the silicon compound usable in the present invention include an organic-inorganic hybrid material disclosed in Korean Patent Laid-open Publication No. 2004-0013816.

In addition, the silicon compound resin composed of the above material may have at least one metal atom therein. The silicon compound having metal may be prepared by substituting a metal atom for a silicon atom of the structure shown in Formula 1, using a precursor formed of a metal atom, such as aluminum, titanium, zirconium or tin. Preferably, the silicon compound is composed of siloxane (—Si—O—) and metal oxide (-M-O—) uniformly linked together as a main skeleton, in which any one of three or more bonding regions of a silicon atom or a metal atom is a linear, branched or cyclic $C_{1-12}$ hydrocarbon group. The silicon compound including the metal atom is advantageous because mechanical or thermal properties may be improved, and various changes of the optical properties may be realized.

Further, in order to confer durability and optical properties of a barrier rib to the silicon compound resin, a pigment is preferably used. The pigment is not particularly limited as long as it imparts durability and optical properties of the barrier rib, and includes both inorganic pigments and typically used pigments. The pigment is exemplified by black pigments, such as ruthenium oxide, nickel oxide, titania, titania-alumina, iron oxide, etc., and white pigments, such as titanium oxide, barium nitride, aluminum oxide, etc. Of the barrier rib materials, the inorganic pigment is used in an amount of 10~60 wt %, based on the weight of the silicon compound. The properties of the barrier rib may be varied with the amount of the inorganic pigment.

Further, a curing agent is added to the silicon compound, to enable curing of the barrier rib material using UV light or heat, thereby manufacturing a barrier rib. The curing agent (or initiator) is not particularly limited, and may be appropriately selected depending on the type of silicon compound resin or the kind of heat or UV light. The exposure time is determined within a range that maintains the shape of a barrier rib and prevents a part of the barrier rib adhering to the master from being separated from the barrier rib when the master is removed.

A barrier rib material including the silicon compound thus prepared is applied or loaded between a master and a rear substrate, to be thus transferred onto a rear substrate having an electrode and a dielectric layer. The transferred barrier rib material is cured using UV light or heat, after which the master is removed from the rear substrate, to manufacture a barrier rib. A method of manufacturing a barrier rib according to the present invention is specifically described below.

FIG. 1 sequentially illustrates a process of manufacturing a barrier rib for a PDP, according to a first embodiment (left side) and a second embodiment (right side) of the present invention, using a flat type master.

The manufacturing method according to the first embodiment of the present invention using a flat type master is described with reference to FIG. 1. First, the surface of a flat type master 11 is patterned to have a pattern having a shape opposite to that of a barrier rib 14, and the flat type master 11 is positioned on a rear substrate 12 to be aligned therewith, so that the formation of a barrier rib is realized through a continuous process. A silicon compound resin 13 for use in the preparation of a barrier rib is applied on the rear substrate 12 and then pressed using the master 11. The silicon compound resin 13 between the master 11 and the rear substrate 12 is formed to be the barrier rib 14 having a shape opposite to that of the pattern of the master 11 while maintaining its strength of attachment to the upper surface of the rear substrate 12, and is cured using heat or UV light. The master 11 is released from the rear substrate 12, with the exception of the barrier rib 14 formed on the rear substrate 12. Thereafter, a curing process is conducted at a temperature lower than 300° C., to complete the formation of barrier rib 14.

In addition, the manufacturing method according to the second embodiment of the present invention using a flat type master is described with reference to FIG. 1. First, the surface of a flat type master 11 is patterned to have a pattern having a shape opposite to that of a barrier rib 14, and the flat type master 11 is positioned on a rear substrate 12 to be aligned therewith, so that the formation of a barrier rib is realized through a continuous process. A silicon compound resin 13 is applied on the patterned surface of the master 11 to be loaded into the pattern grooves of the master 11. Subsequently, through the pressing process of the flat type master 11 on the rear substrate 12, the silicon compound resin 13 loaded into the grooves of the master 11 is attached to the upper surface of the rear substrate 12 and is cured using heat or UV light. The master 11 is removed from the rear substrate 12, and a curing process is then carried out at a temperature lower than 300° C., to complete the desired barrier rib 14.

In addition to the use of the flat type master in the manufacturing method according to the first embodiment or second embodiment of the present invention, a roll type master may be applied to manufacture the same barrier rib, which is described below, with reference to FIG. 2.

The manufacturing method according to the first embodiment using a roll type master is described as shown in FIG. 2 (left side). First, the surface of a roll type master 15 is patterned to have a pattern having a shape opposite to that of a barrier rib 14, and the roll type master 11 is positioned on a rear substrate 12 to be aligned therewith, so that the formation of a barrier rib is realized through a continuous process. A silicon compound resin 13 is applied on the rear substrate 12, and is then pressed using the master 15. The silicon compound resin 13 between the master 15 and the rear substrate 12 is formed into the barrier rib 14 having a shape opposite to that of the pattern of the roll type master 15 while maintaining its strength of attachment to the rear substrate 12, and is cured using heat or UV light at the same time. While the master 15 is continuously rotated, it is removed from the rear substrate 12, with the exception of the barrier rib 14 formed on the rear substrate 12. Thereafter, a curing process is performed at a temperature lower than 300° C., to complete the formation of barrier rib 14.

In addition, the manufacturing method according to the second embodiment using a roll type master is described with reference to FIG. 2 (right side). First, the surface of a roll type master 15 is patterned to have a pattern having a shape opposite to that of a barrier rib 14, and the roll type master 15 is positioned on a rear substrate 12 to be aligned therewith, so that the formation of a barrier rib is realized through a continuous process. A silicon compound resin 13 is applied on the patterned surface of the master 15 to be loaded into the pattern grooves of the master 15. The roll type master 15 is pressed on the rear substrate 12 while being rotated, thereby simultaneously attaching the silicon compound resin 13 loaded into the grooves of the master 15 to the upper surface of the rear substrate 12 and curing it into the barrier rib 14 using heat or UV light. The master 15 is then removed from the rear substrate 12. Subsequently, a curing process is performed at a temperature lower than 300° C., to complete the formation of barrier rib 14.

The flat type master and the roll type master may be used alone or in combination. For example, the flat type master may be applied to the portion of the master where the silicon compound resin is applied or loaded or the portion of the master coming in contact with the rear substrate, while the master travels by the roll, thereby simultaneously using the flat type master and the roll type master.

Further, the pattern of the master, corresponding to the shape of the barrier rib, may vary. For example, a stripe type barrier rib may be formed in a manner such that the transfer direction of the master and the disposition of barrier ribs are controlled in the range of 0~90° C. from the traveling direction of the master. In addition, it is easy to continuously manufacture a honeycomb or meandering type barrier rib.

The material for a master is not particularly limited as long as it may be used in all types including a roll type, a flat type, and a combination thereof.

A better understanding of the present invention may be obtained in light of the following examples which are set forth to illustrate, but are not to be construed to limit the present invention.

Example 1

13.11 g of 3-glycidoxypropyltrimethoxysilane (Aldrich) and 10.05 g of diisobutylsilanediol were mixed together, added with 0.1 g of sodium hydroxide as a catalyst, and then allowed to react at 80° C. for 3 hr, to prepare a solution. The solution thus prepared was heated at 60° C. in a vacuum to extract all of the methanol, and then added with 0.1 g of UVI 6992 (DOW) as an epoxy initiator, to prepare a silicon compound resin containing a curing agent.

To the silicon compound resin, titania as an inorganic pigment was added in varying amounts of 20, 30, 40, 50 and 60 wt %. The properties of a barrier rib could be varied with the amount of titania, as shown in Table 1 below.

TABLE 1

| | |
|---|---|
| Dielectric Constant (@ 1 MHz) | 6~13 |
| Coefficient of Thermal Expansion ($10^{-6}$/° C.) | 10~80 |
| Curing Temp. (° C.) | 150~220 |
| Reflectance (@ 500 nm, %) | 50~80 |

The silicon compound resin containing the curing agent and the pigment was subjected to a stamping process on a rear substrate using a master made of PDMS, as shown in the right side of FIG. 1, to form a barrier rib. At this time, the curing process was conducted using UV light at 365 nm through a 500 W mercury lamp as a light source for an exposure time of 1 min, while continuously conducting the pressing process.

Subsequently, the master was released from the temporarily formed barrier rib and the rear substrate, after which the master was completely removed from the rear substrate. Thereby, the transferring process was completed, followed by a curing process at 200° C. for 3 hr, thus forming a final barrier rib having a height of 140 □, a thickness of 140 □ and cell pitches of 380 □ (FIGS. 3 and 4).

Example 2

5 wt % of 2,5-dimethyl-2,5-t-butylperoxy hexane (Aldrich) as a curing agent was added to PDMS (MW: 28,000, Bayer) having a vinyl group, to prepare a silicon compound resin.

As in Example 1, titania as an inorganic pigment was added to the silicon compound resin in varying amounts of 20, 30, 40, 50 and 60 wt %. The properties of a barrier rib were confirmed to vary with the amount of titania as seen in Table 1.

The silicon compound resin containing the inorganic pigment and the curing agent was subjected to a process of stamping on a rear substrate using a roll type master made of stainless steel, as shown in the left side of FIG. 2, to form a barrier rib. At this time, in the pressing process of the roll type master, the contact portion between the roll type master and the silicon compound resin layer was cured by exposure to heat. For heat supply, a roll having hot wires at 150° C. was used, and hot wires at 150° C. were additionally installed, parallel to the roll, under the rear substrate, to heat cure the barrier rib material. As such, the roll 15 was rotated at 1 rpm.

Subsequently, the roll type master was naturally removed from the temporarily formed barrier rib and the rear substrate while being rotated on the barrier rib and the rear substrate. Thereby, the transferring process was completed, followed by a curing process at 180° C. for 4 hr, thus forming a final barrier rib.

Example 3

A barrier rib was manufactured in the same manner as in Example 1, with the exception that a different silicon compound resin was used. The silicon compound resin used in this Example was prepared as follows.

That is, 13.11 g of 3-methacryloxypropyl trimethoxysilane (Aldrich) and 10.05 g of diisobutylsilanediol were mixed together, added with 0.1 g of sodium hydroxide as a catalyst, and then allowed to react at 80° C. for 3 hr, to prepare a solution. The reaction solution was added with 0.25 g of 2,2-dimethoxy-2-phenyl-acetophenone (Aldrich) as a UV curing initiator, to prepare a silicon compound resin. To the silicon compound resin thus prepared, titania as an inorganic pigment was added in varying amounts of 20, 30, 40, 50 and 60 wt %.

Example 4

A barrier rib was manufactured in the same manner as in Example 2, with the exception that a different silicon compound resin was used. The silicon compound resin used in this Example was prepared as follows.

That is, 9.417 g of epoxycyclohexylisobutyl-polysilsesquioxane (MW: 1026, Aldrich) and 3.664 g of bis(3,4-epoxycyclohexylmethyl)adipate (Aldrich) were dissolved in 10 g of tetrahydrofuran and then stirred at room temperature for 3 hr. Aluminum 2-butoxide as an initiator was added in an amount of 5 wt % based on the total amount of the epoxy group, to prepare a silicon compound resin. To the silicon compound resin thus prepared, titania as an inorganic pigment was added in varying amounts of 20, 30, 40, 50 and 60 wt %.

Example 5

13.78 g of 3-methacryloxypropyltrimethoxysilane (Aldrich) and 12.00 g of diphenylsilancdiol (Fluka) were mixed together, added with 0.1 g of sodium hydroxide as a catalyst for the acceleration of a siloxane reaction, and then stirred at 80° C. for 6 hr, to prepare a silicon compound resin. The silicon compound resin thus prepared was added with 6.7 g of titania as an inorganic pigment and 0.25 g of 2,2-dimethoxy-2-phenyl-acetophenone (Aldrich) as a photoinitiator for acryl curing.

The silicon compound resin thus obtained was used to manufacture barrier ribs according to the four methods shown in FIGS. 1 and 2. Upon manufacturing the barrier rib through each method, UV light of 3 J/□ was radiated using a UV lamp at 365 nm, and a curing process was conducted at 200° C. for 3 hr, to manufacture a desired barrier rib.

Example 6

13.78 g of 3-glycidoxypropyltrimethoxysilane (Aldrich) and 12.00 g of diphenylsilanediol (Fluka) were mixed together, added with 0.1 g of sodium hydroxide as a catalyst for the acceleration of a siloxane reaction, and then stirred at 80° C. for 6 hr, to prepare a silicon compound, which was then added with 6.7 g of titania as an inorganic pigment and 0.25 g of 1-methylimidazole (Aldrich) as a heat initiator for epoxy curing.

The silicon compound resin thus obtained was used to manufacture barrier ribs according to the four methods shown in FIGS. 1 and 2. Upon manufacturing the barrier rib through each method, a curing process was conducted using heat at 130° C., and a curing process was conducted at 220° C. for 3 hr, to manufacture a desired barrier rib.

Example 7

5.78 g of 3-glycidoxypropyltrimethoxysilane (Aldrich), 7.87 g of 3-methacryloxypropyltrimethoxysilane (Aldrich), and 12.00 g of diphenylsilanediol (Fluka) were mixed together, added with 0.1 g of sodium hydroxide as a catalyst for the acceleration of a siloxane reaction, and then stirred at 80° C. for 6 hr, to prepare a silicon compound resin. The silicon compound resin thus prepared was added with 6.7 g of titania as an inorganic pigment and 1.36 g of bisphenol-A (Aldrich) in 20 g of toluene, and then with 0.25 g of 1-methylimidazole (Aldrich) as a heat initiator for epoxy curing.

The silicon compound resin thus obtained was used to manufacture barrier ribs according to the four methods shown in FIGS. 1 and 2. Upon manufacturing the barrier rib through each method, a curing process was conducted at 130° C., and a curing process was conducted at 200° C. for 3 hr, to manufacture a desired barrier rib.

Example 8

A silicon compound resin was prepared and then a barrier rib was manufactured in the same manner as in Example 5, with the exception that 10.33 g of 3-methacryloxypropyltrimethoxysilane (Aldrich) and 3.45 g of zirconium tetraisopropoxide were used, instead of 13.78 g of 3-methacryloxypropyltrimethoxysilane (Aldrich).

Example 9

A silicon compound resin was prepared and then a barrier rib was manufactured in the same manner as in Example 6, with the exception that 10.33 g of 3-glycidoxypropyltrimethoxysilane (Aldrich) and 3.45 g of zirconium tetraisopropoxide were used, instead of 13.78 g of 3-glycidoxypropyltrimethoxysilane (Aldrich).

Example 10

A silicon compound resin was prepared and then a barrier rib was manufactured in the same manner as in Example 5, with the exception that 9.83 g of 3-methacryloxypropyltrimethoxysilane (Aldrich) and 3.28 g of titanium tetraethoxide were used, instead of 13.11 g of 3-methacryloxypropyltrimethoxysilane (Aldrich).

Example 11

A silicon compound resin was prepared and then a barrier rib was manufactured in the same manner as in Example 6, with the exception that 9.83 g of 3-glycidoxypropyltrimethoxysilane (Aldrich) and 3.28 g of titanium tetraethoxide were used, instead of 13.11 g of 3-glycidoxypropyltrimethoxysilane (Aldrich).

Example 12

A silicon compound resin was prepared and then a barrier rib was manufactured in the same manner as in Example 7, with the exception that 4.28 g of 3-glycidoxypropyltrimethoxysilane (Aldrich), 1.5 g of zirconium tetraisopropoxide, 5.9 g of 3-methacryloxypropyl trimethoxysilane (Aldrich), and 1.97 g of titanium tetraethoxide were used, instead of 5.78 g of 3-glycidoxypropyltrimethoxysilane (Aldrich) and 7.87 g of 3-methacryloxypropyltrimethoxysilane (Aldrich).

Example 13

A silicon compound resin was prepared and then a barrier rib was manufactured in the same manner as in Example 7, with the exception that 1.95 g of methacrylic acid (Aldrich), 2.3 g of 3-methacryloxypropyl trimethoxysilane (Aldrich), and 7.87 g of 3-glycidoxypropyltrimethoxysilane (Aldrich) were used, instead of 5.78 g of 3-glycidoxypropyltrimethoxysilane (Aldrich) and 7.87 g of 3-methacryloxypropyl trimethoxysilane (Aldrich).

Example 14

A silicon compound resin was prepared and then a barrier rib was manufactured in the same manner as in Example 7, with the exception that 4.28 g of 3-glycidoxypropyltrimethoxysilane (Aldrich), 1.5 g of zirconium tetraisopropoxide, 0.95 g of methacrylic acid (Aldrich), 3.3 g of 3-methacryloxypropyltrimethoxysilane (Aldrich), and 1.97 g of titanium tetraethoxide were used, instead of 5.78 g of 3-glycidoxypropyltrimethoxysilane (Aldrich) and 7.87 g of 3-methacryloxypropyl trimethoxysilane (Aldrich).

Example 15

A silicon compound resin was prepared and then a barrier rib was manufactured in the same manner as in Examples 5 to 15, with the exception that 13.56 g of diphenyldimethoxysilane (Fluka) and 2 g of water for hydrolysis and condensation were used, instead of diphenylsilanediol.

INDUSTRIAL APPLICABILITY

As described hereinbefore, the present invention provides a method of manufacturing a barrier rib for a PDP. According to the method of the present invention, a barrier rib composition in a liquid phase, which does not contain PbO and may be cured even at a low temperature not higher than 300° C., can be easily formed into a barrier rib through a transferring process using a master. Further, since the temperature of the curing process may be decreased, a soda lime glass substrate or a plastic substrate, suitable for low temperatures, may be used.

In addition, a silicon compound resin is used as a material for a barrier rib, and it is thus possible to precisely manufacture a barrier rib having a fine and complicated shape and to continuously manufacture the barrier rib. Upon manufacturing of the barrier rib, the barrier rib material is not excessively used, thus generating less environmental pollution. Moreover, the manufacturing processes are simplified, resulting in reduced manufacturing costs.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method of manufacturing a barrier rib for a plasma display panel, comprising: providing a silicon compound resin layer on a substrate;

wherein the silicon compound comprises a compound including a compound material represented by Formula 1 below or by $R_6SiO_{1.5}$ as a repeating unit, or a polymer including the compound material as a monomer;

pressing the silicon compound resin layer using a master having a pattern corresponding to a shape of a barrier rib to be transferred; and curing the silicon compound resin and then releasing the master;

Formula 1

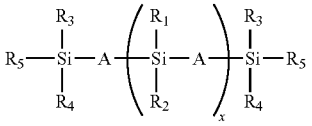

wherein X is an integer, including 0, $R_1$, $R_2$, $R_3$, $R_4$, $R_5$ and $R_6$ are each a linear, branched or cyclic $C_{1-12}$ hydrocarbon group having a functional group selected from among an alkyl group, a ketone group, an acryl group, a methacryl group, an allyl group, an alkoxy group, an aromatic group, a halogen group, an amino group, a mercapto group, an ether group, an ester group, a sulfone group, a nitro group, a hydroxyl group, a cyclobutene group, a carbonyl group, a carboxyl group, an alkyd group, a urethane group, a vinyl group, a nitrile group, hydrogen, an epoxy group, and mixtures thereof, and A is O or NH, in which the $C_{1-12}$ hydrocarbon group includes fluorine substituted for hydrogen thereof.

2. The method according to claim 1, wherein the silicon compound resin further comprises a pigment.

3. The method according to claim 2, wherein the pigment is selected from a group consisting of ruthenium oxide, nickel oxide, titania, titania-alumina, iron oxide, titanium oxide, barium nitride, aluminum oxide, and mixtures thereof.

4. A plasma display panel, comprising a silicon compound resin and manufactured using the method of claim 3.

5. The method according to claim 1, wherein the silicon compound resin further comprises a UV curing agent or a heat curing agent.

6. A plasma display panel, comprising a silicon compound resin and manufactured using the method of claim 5.

7. The method according to claim 1, wherein the master is a flat type or a roll type.

8. The method according to claim 1, wherein the silicon compound resin comprises at least one metal atom substituted for a silicon atom.

9. A plasma display panel, comprising a silicon compound resin and manufactured using the method of claim 8.

10. A plasma display panel, comprising a silicon compound resin and manufactured using the method of claim 1.

11. A method of manufacturing a barrier rib for a plasma display panel, comprising: loading a silicon compound resin into grooves of a master having a pattern corresponding to a shape of a barrier rib, wherein the silicon compound comprises a compound including a compound material represented by Formula 1 below or by $R_6SiO_{1.5}$ as a repeating unit, or a polymer including the compound material as a monomer;

pressing the master on a substrate to transfer the silicon compound to the substrate; and curing the transferred silicon compound and then releasing the master;

Formula 1

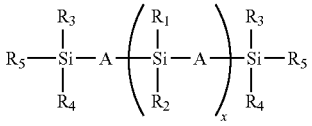

wherein X is an integer, including 0, $R_1$, $R_2$, $R_3$, $R_4$, $R_5$ and $R_6$ are each a linear, branched or cyclic $C_{1-12}$ hydrocarbon group having a functional group selected from among an alkyl group, a ketone group, an acryl group, a methacryl group, an allyl group, an alkoxy group, an aromatic group, a halogen group, an amino group, a mercapto group, an ether group, an ester group, a sulfone group, a nitro group, a hydroxyl group, a cyclobutene group, a carbonyl group, a carboxyl group, an alkyd group, a urethane group, a vinyl group, a nitrile group, hydrogen, an epoxy group, and mixtures thereof, and A is O or NH, in which the $C_{1-12}$ hydrocarbon group includes fluorine substituted for hydrogen thereof.

12. The method according to claim 11, wherein the silicon compound resin further comprises a pigment.

13. The method according to claim 12, wherein the pigment is selected from a group consisting of ruthenium oxide, nickel oxide, titania, titania-alumina, iron oxide, titanium oxide, barium nitride, aluminum oxide, and mixtures thereof.

14. A plasma display panel, comprising a silicon compound resin and manufactured using the method of claim 13.

15. The method according to claim 11, wherein the silicon compound resin further comprises a UV curing agent or a heat curing agent.

16. A plasma display panel, comprising a silicon compound resin and manufactured using the method of claim 15.

17. The method according to claim 11, wherein the master is a flat type or a roll type.

18. The method according to claim 11, wherein the silicon compound resin comprises at least one metal atom substituted for a silicon atom.

* * * * *